US005711477A

United States Patent [19]

Jenkins

[11] Patent Number: 5,711,477

[45] Date of Patent: Jan. 27, 1998

[54] REVERSE FOLD SIFT PROOF CARTON HAVING AN ADHESIVE PATTERN THEREON

[75] Inventor: Paul M. Jenkins, Yorba Linda, Calif.

[73] Assignee: Illinois Tool Works Inc., Glenview, Ill.

[21] Appl. No.: 566,522

[22] Filed: Dec. 4, 1995

Related U.S. Application Data

[62] Division of Ser. No. 273,206, Jul. 11, 1994.

[51] Int. Cl.[6] ..... B65D 5/06

[52] U.S. Cl. ..... 229/136; 229/132

[58] Field of Search ..... 229/132, 134, 229/136

[56] References Cited

U.S. PATENT DOCUMENTS

| | | | |
|---|---|---|---|
| 1,974,256 | 9/1934 | Bergstein . | |
| 2,670,128 | 2/1954 | Stowitts | 229/132 |
| 2,903,833 | 9/1959 | Jones . | |
| 2,970,525 | 2/1961 | Klein et al. . | |
| 2,996,235 | 8/1961 | Turpin | 229/132 X |
| 3,018,701 | 1/1962 | Keely . | |
| 3,140,215 | 7/1964 | Russell | 229/132 X |
| 3,297,229 | 1/1967 | Bluem | 229/132 |
| 3,330,466 | 7/1967 | Eckles | 229/132 |
| 3,831,342 | 8/1974 | Rejsa . | |
| 3,934,791 | 1/1976 | Dick et al. | 229/134 X |
| 4,156,398 | 5/1979 | McDaniel . | |
| 4,501,388 | 2/1985 | Cassidy | 229/134 X |
| 5,024,709 | 6/1991 | Faulkner, III et al. . | |
| 5,472,137 | 12/1995 | Jenkins | 229/136 X |

*Primary Examiner*—Allan N. Shoap
*Assistant Examiner*—Christopher J. McDonald
*Attorney, Agent, or Firm*—Schwartz & Weinrieb

[57] ABSTRACT

A method and adhesive pattern for reverse folding and sealing a carton that enables the carton to be sift proof, the method including providing a carton having a first open end including first and second inside and outside major flaps and a pair of opposing minor flaps. The minor flaps and outside major flap are initially folded in an open position and the first inside major flap is folded to cover the open end of the carton. Multiple beads of adhesive are then applied with a non-contact application head to selected areas of the first inside major flap, the second outside major flap and both of the minor flaps. The minor flaps are then folded on top of the first inside major flap and the second outside major flap is folded on top of the minor flaps to provide sealing contact between the flaps about the entire periphery of the first open end so that the carton is sift proof.

13 Claims, 2 Drawing Sheets

FIG. 1
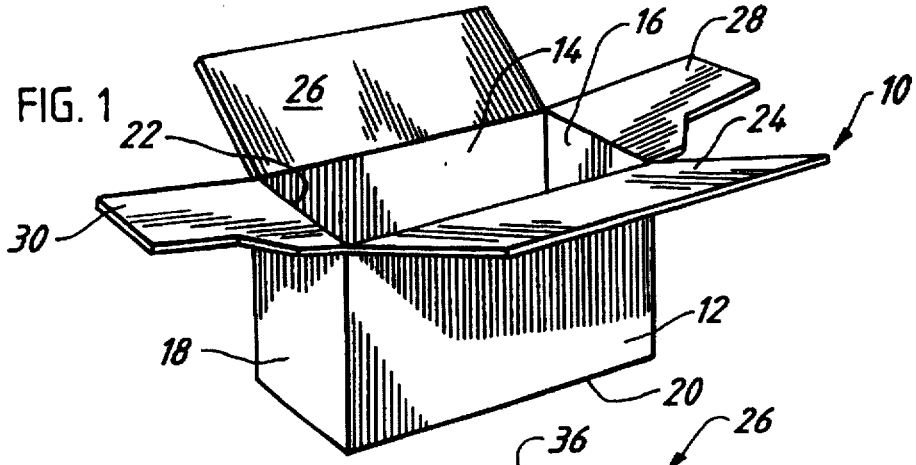
FIG. 2
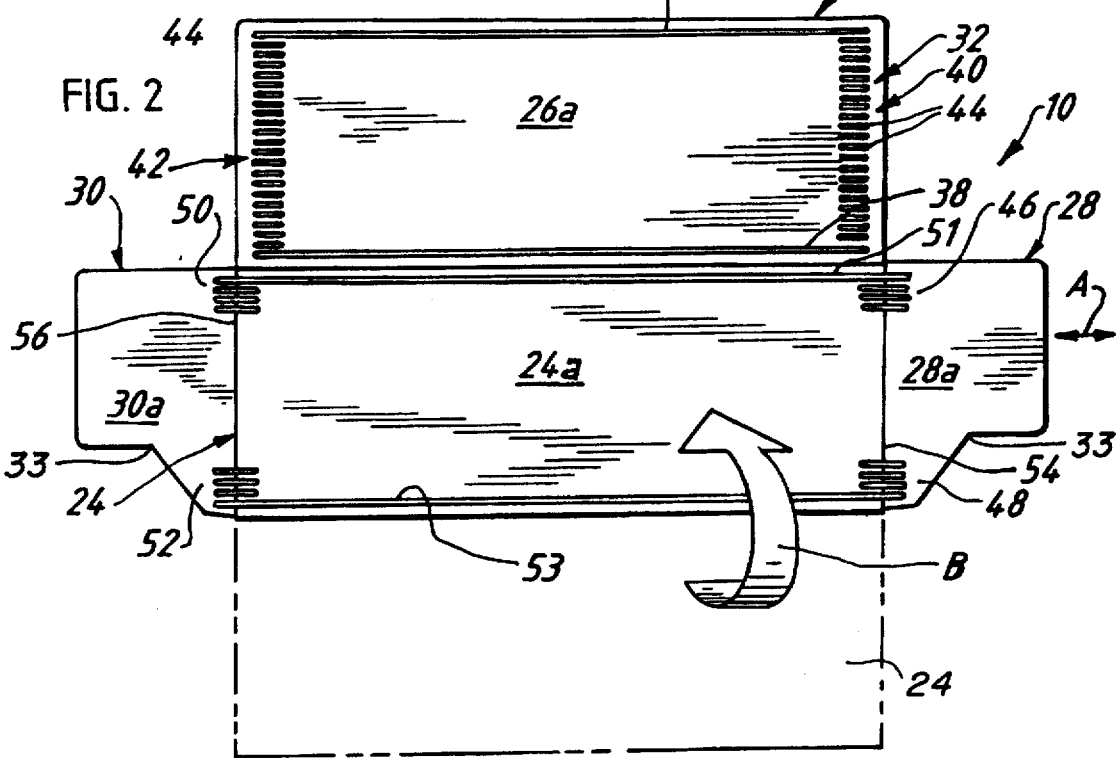
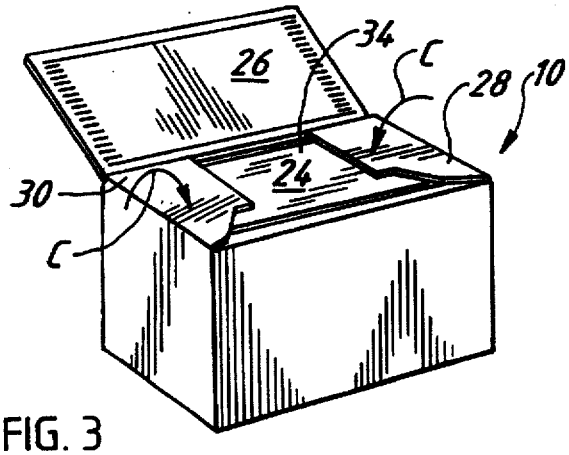
FIG. 3
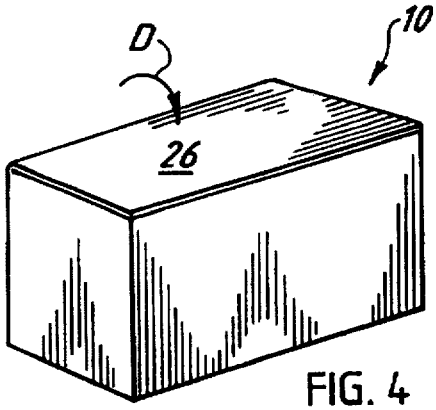
FIG. 4

REVERSE FOLD SIFT PROOF CARTON HAVING AN ADHESIVE PATTERN THEREON

This application is a division of application Ser. No. 08/273,206, filed Jul. 11, 1994.

TECHNICAL FIELD

The present invention relates generally to methods for erecting and adhesively sealing cartons, and more particularly, to a method of reverse folding a carton with a predetermined pattern of adhesive beads provided by a non-contact application head which provides a sift proof carton when major and minor end flaps are folded.

BACKGROUND OF THE INVENTION

A carton, box or container is typically made of a paper material, such as cardboard or the like, and includes a plurality of flaps at opposite open ends of the carton which must be folded and connected to provide a closed carton. Such cartons are usually provided in a flat, folded state to a manufacturer who then erects the carton, closes and seals one open end, inserts a desired product and closes and seals the opposite end of the carton.

Machinery for erecting, folding and sealing a carton with a product therein are either intermittent or continuous motion systems. In an intermittent system, the carton is sequentially conveyed to a plurality of positions along an assembly line where the carton is stopped for a predetermined time period at each position so that a desired operation can be performed on the carton. In such a system, since the carton is substantially stationary for a short period of time, machinery can be provided at each position which can be movable with respect to the carton to provide the desired operation.

In a continuous motion system, cartons are continuously in motion, one after another, through the system. As the cartons move through the system, they cooperate with various apparatus which are substantially stationary with respect to the moving cartons and perform the desired operations on the cartons. Continuous motion systems dramatically increase the output approximately 5–10 times that of an intermittent system, but require completely different equipment due to the continuous motion of the cartons.

Cartons are typically closed by folding end flaps of the carton using either a "conventional" or a "reverse fold" method and then securing the flaps together with tape, an adhesive or with some other means. In a conventional folding method, opposite minor end flaps are folded first, followed by a first inside major flap and finally a second outside major flap. In a reverse fold method, the first inside major flap is initially folded, followed by the opposite minor flaps and finally the second outside major flap.

When the carton contains a granular or powdered product, the powder tends to work its way out of the carton between the folded and secured flaps during shipping and handling. One way to prevent such leakage is to provide the carton with an inner liner or pouch, such as a plastic bag. A liner, however, significantly increases the cost of the carton, can make the carton difficult to fill and seal with product and can be difficult to recycle since most users neglect to remove and separate the carton and liner for recycling.

Another way to prevent leakage without providing a liner is to provide a "sift proof" carton, preferably sealed with an adhesive. Sift proof adhesively sealed cartons rely on a predetermined pattern of a substantially quick setting adhesive and proper engagement between respective flaps.

Attempts to provide a sift proof carton for very small grain powders with a conventionally folded adhesive carton have not been successful since such powders leak at the corners as well as at improperly sealed edges. Leakage in a conventionally folded adhesion carton primarily occurs from poor adhesion between the minor flaps and the first inside major flap.

Cartons assembled by a reverse fold method and adhesive provide better sift proof qualities than those assembled by a conventional folding method primarily because the first inside major flap, not the minor flaps, is folded first. Thus better adhesion can be provided between the minor flaps and the first inside major flap, particularly near the corners thereof, to prevent leakage.

Accordingly, with a reverse folded carton, the adhesive must be applied to ensure that no leakage occurs between the first inside major flap and both minor flaps. Existing cartons assembled with an adhesive and in accordance with a reverse fold method are typically provided with the adhesive by means of either a contact or non-contact application head as illustrated in FIGS. 5 and 6, respectively.

With the contact type of adhesive application head of FIG. 5, the adhesive is applied with one or more film contact heads to provide the desired pattern. Such an application head, however, cannot apply adhesive with precision, including adhesive placement and thickness, and frequently results in adhesive being squeezed out of the carton which is not acceptable.

With the non-contact type of adhesive application head of FIG. 6, the adhesive is only applied to the first and second inside and outside major flaps. These existing reverse folded cartons, however, leave small gaps between the edges of the first inside major flap and the minor flaps. Thus, powdered or small grain products can enter and migrate along these gaps to eventually leak out of the corners.

It therefore would be desirable to provide a method and adhesive pattern for providing a reverse folded, sift proof, linerless carton that can be utilized in an intermittent or continuous carton erecting and sealing system and can accommodate a variety of granular and powdered materials without leakage.

SUMMARY OF THE INVENTION

The present invention provides a method of folding and sealing the end flaps of a carton with an adhesive pattern to provide a sift proof container. The method is preferably a reverse fold method which includes providing a carton having at least a first open end including a first inside major flap, a second outside major flap and a pair of opposing minor flaps, each flap being connected for rotation with respect to the first open end for closing off the first open end.

The minor flaps and the second outside major flap are initially positioned in a predetermined open position with respect to the first end of the carton. The second major flap is then folded to cover the first open end of the carton. Multiple beads of adhesive are then applied by a non-contact adhesive application head to selected areas of the first inside major flap, the second outside major flap and both of the minor flaps. The minor flaps are then folded onto the first inside major flap and the second outside major flap is then folded over the minor flaps and the first inside major flap.

The adhesive preferably extends across the interstice between the first inside major flap and both of the minor flaps so that a sift proof seal is provided therebetween. If desired, the minor flaps can be configured so that the second outside major flap engages the first inside minor flap to further increase the sift proof qualities of the carton.

BRIEF DESCRIPTION OF THE DRAWINGS

Various objects, features, and attendant advantages of the present invention will be more fully appreciated from the following detailed description when considered in connection with the accompanying drawings in which like reference characters designate like or corresponding parts throughout the several views and wherein:

FIG. 1 is a perspective view of a carton illustrating an open end thereof and the respective major and minor flaps which are provided with an adhesive pattern of the invention and folded in a reverse fold manner to provide a sift proof container;

FIG. 2 is a top plan view of the carton of FIG. 1 with the inside major flap folded over and illustrating the preferred adhesive pattern of the invention;

FIG. 3 is a perspective view, similar to FIG. 1, but illustrating the inside major flap and both minor flaps in a folded position;

FIG. 4 is a perspective view of the carton completely folded according to the invention;

DESCRIPTION OF THE PREFERRED EMBODIMENTS

Figure 5:
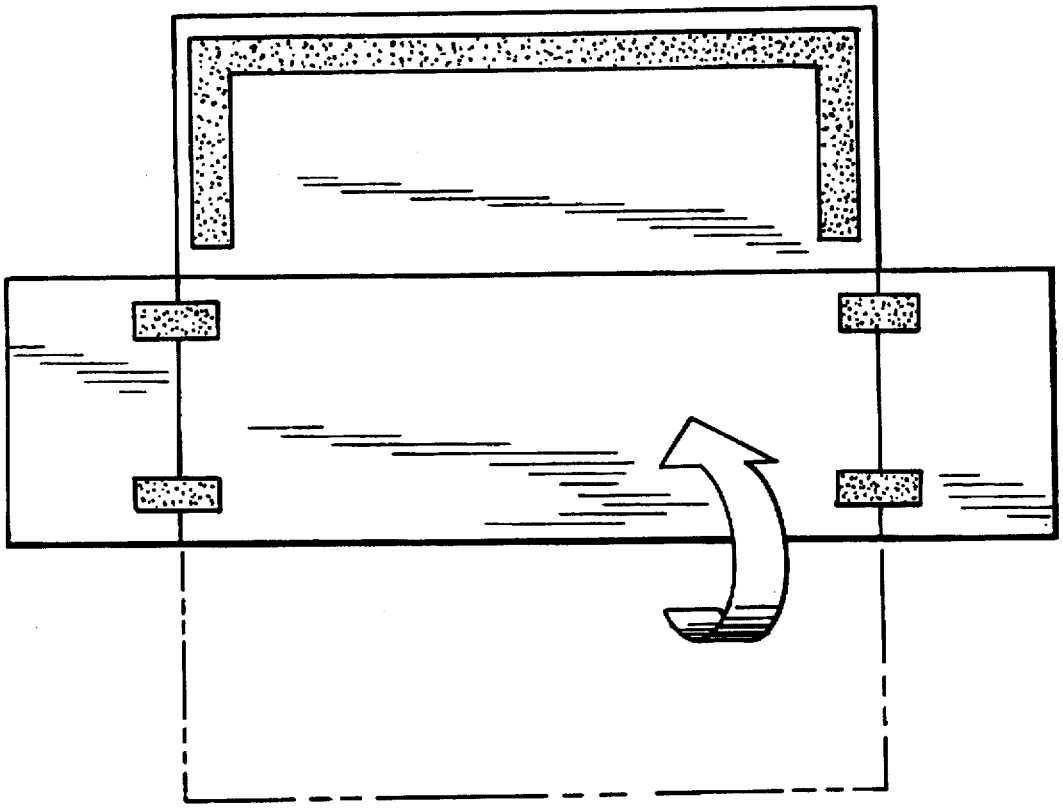
FIG. 5 PRIOR ART
FIG. 5 is a top plan view of a carton with an inside major flap folded inwardly and illustrating a prior art adhesive pattern applied with one or more contact adhesive application heads in an intermittent system.

Referring to FIG. 1, a carton which is to be folded and sealed according to the principles of the present invention is generally designated by reference numeral 10. The carton 10 is preferably rectangular and made of paperboard, but the particular shape and material of the carton 10 can vary.

The carton 10 preferably includes first and second major panels 12 and 14, first and second opposing minor panels 16 and 18, a bottom 20 and a top 22. The bottom 20 and top 22 are initially provided in an open condition and are closed off by a plurality of flaps described in detail below.

For ease of description, the present invention will be described with respect to a carton 10 where the bottom 20 is already provided in a closed position and sealing of the flaps is described with respect to the top 22. It is to be understood, however, that the principles of the present invention can be applied to folding and sealing the flaps of the top 22 and/or bottom 20 in any desired order and with both the top 22 and bottom 20 initially opened.

The top 22 includes a first inside major flap 24, a second outside major flap 26, and first and second minor flaps 28 and 30. Each flap 24, 26, 28 and 30 is hingedly attached to the sides 12, 14, 16 and 18, respectively, of the carton 10, preferably by scoring portions of the carton 10, for folding over and sealing the open top 22.

The carton 10 is preferably erected and sealed in a continuous system (not illustrated) where the carton 10 is transported through the continuous system along its longitudinal axis as illustrated by the arrow "A" in FIG. 2. The particular direction of travel, however, can vary and the carton 10 can be assembled in an intermittent system if desired.

In the present invention, the carton 10 is assembled according to a reverse fold method as described above. Accordingly, as FIGS. 2–4 illustrate, the first inside major flap 24 is initially folded over the open top 22 as illustrated by arrow "B" in FIG. 2.

Next, the second major flap 26 and the first and second minor flaps 28 and 30 are positioned substantially within the same plane, which is preferably substantially perpendicular with respect to the panels 12–18 of the carton 10. Once so positioned, an adhesive pattern generally illustrated with the reference numeral 32 is applied over selected areas of all of the flaps 24, 26, 28 and 30 as shown in FIG. 2.

As FIG. 3 illustrates, the first and second minor flaps 28 and 30 are then folded over the first inside major flap 24 in the direction of arrows "C". Finally, as FIG. 4 illustrates, the second outside major flap 26 is folded over the first and second minor flaps 28 and 30 in the direction of arrow "D".

It is to be noted that the first and second major flaps 24 and 26 are illustrated as rectangular in shape and substantially span the entire cross-sectional area of the carton 10, but the size and shape of the first and second major flaps 24 and 26 can vary. As FIG. 2 illustrates, the first and second minor flaps 28 and 30 are preferably die-cut to include cutouts 33 to enable adhesive 32 on the second outside major flap 26 to directly engage the first inside major flap 24 when folded as described below. The particular size and shape of the first and second minor flaps 28 and 30 can vary according to the desired application.

Additionally, as FIG. 3 illustrates, the first and second minor flaps 28 and 30 each preferably have a length less than half the length of the major flaps 24 and 26 so that, when folded, a gap or interstice 34 is provided therebetween. The gap 34 can vary depending on the size of the minor flaps 28 and 30 and enables contact of the adhesive 32 on the second major flap 26 to contact the first major flap 24 as described below.

In the present invention, the cooperation between the particular flaps 24–30 and the pattern of adhesive 32 provides the unique sift proof features of the invention. The adhesive 32 is a relatively quick setting adhesive so that it will bite or grip the flaps 24–30 upon folding and maintain that grip until fully cured.

The adhesive 32 is preferably provided by a non-contact adhesive nozzle plate or application head (not illustrated) which is stationery within the continuous system and includes a plurality of adhesive outlet apertures, nozzles or injection needles which provide a plurality of adhesive beads and are arranged and controlled in a plurality of zones. The carton 10 is passed over or under the nozzle plate where the zones as well as the duration or length of adhesive application can be adjusted to vary the pattern as desired.

In a preferred embodiment, the adhesive is a packaging grade adhesive which can be a hot-melt or cold adhesive. The non-contact application head includes the nozzle plate and corresponding valve systems supplied by the assignee herein under the name "Mod-Plus" and related assemblies.

As FIG. 2 illustrates, a portion of the adhesive 32 is provided on an inside surface **26*a* of the second outside major flap 26 and includes first and second caulk lines 36 and 38 as well as opposite end portions 40 and 42. The caulk lines are optional and preferably extend substantially along the entire length of the flap 26 and are single beads or lines of adhesive 32 which are provided from respective zones of the application head. The caulk lines 36 and 38**, however, can be multiple lines (not illustrated) if desired.

When the second outside major flap 26 is folded as illustrated in FIG. 4, the caulk lines 36 and 38 engage and seal respective portions of the first and second minor flaps 28 and 30 or adhesive thereon as described below. Additionally, due to the gap 34 and cutouts 33 of the die-cut minor flaps 28 and 30, the caulk lines 36 and 38 engage the first inside major flap 24.

Each end portion 40 and 42 of the pattern of adhesive 32 is composed of a plurality of lines 44 of adhesive having a specified length and spacing which can vary. The end portions 40 and 42 are provided by one or more zones of adhesive and are provided by the same portion of the nozzle plate.

The spacing between lines 44 can vary and is selected so that, upon folding and slight compression, each line 44 of adhesive spreads out to provide a continuous band of adhesive along the lateral margins of the second major flap 26. To change the length of the lines 44, the duration of adhesive application is varied while the carton 10 is moving in the direction of arrow "A".

In order to provide a good seal between the minor flaps 28 and 30 and the first inside major flap 24, the pattern of adhesive 32 also includes four segments 46, 48, 50 and 52 and two caulk lines 51 and 53 as illustrated in FIG. 2. The segments 46–52 each extend along a portion of an outside surface 24*a* of the inside major flap 24 and inside surfaces 28*a* and 30*a* of the minor flaps 28 and 30, respectively.

The caulk lines 51 and 53 span the entire length of the inside major flap 24 and portions of the minor flaps 28 and 30. The caulk lines 51 and 53 are optional, provided either caulk lines 36 or 38 are present.

It is to be noted that the segments 46–52 span slight gaps 54 and 56 between the first inside major flap 24 and the minor flaps 28 and 30. The segments 46–52 provide a seal between the first inside major flap 24 and the minor flaps 28 and 30 which closes off the gaps 54 and 56, particularly near the corners of the carton 10, and provides the unique sift proof feature of the invention which is particularly effective with powdered products.

Figure 6:
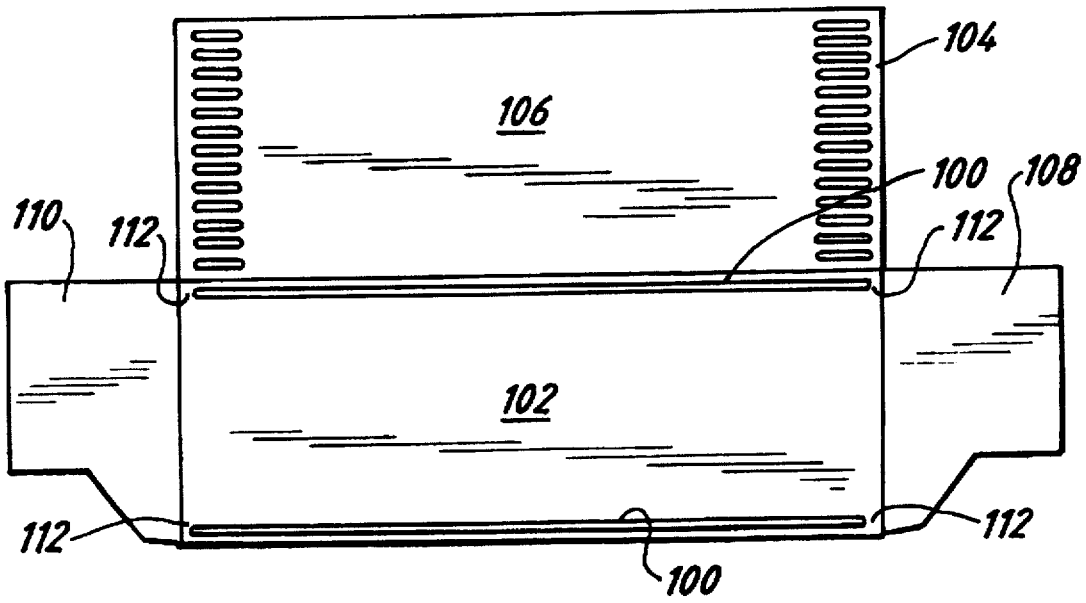
FIG. 6 PRIOR ART
FIG. 6 is a top plan view of a carton with an inside major flap folded inwardly illustrating a prior art adhesive pattern.

In contrast, as illustrated with the prior art adhesive pattern of FIG. 6, caulk lines 100 are provided on the first major flap 102, and adhesive segments 104 are only provided on the second major flap 106. Since the segments 104 do not span the gap between the first major flap 102 and minor flaps 108 and 110, a slight space 112 exists between the segments 104 and the edge of the first major flap 102. The space 112 is sufficient to enable powdered product to escape from the carton, particularly at the corners, which prevents the carton from being sift proof and cannot be eliminated with such a pattern and system.

Accordingly, in the present invention, by applying adhesive 32 all the way to the edge of the first inside major flap 24, across the gaps 54 and 56, and onto the minor flaps 28 and 30, the space 112 of the prior art carton of FIG. 6 is eliminated. This dramatically improves the sift proof features of the invention.

It is to be noted that, despite the segments 46–52 being applied over the gaps 54 and 56, substantially no adhesive 32 enters the inside of the carton 10. This is attributed to a combination of factors including the speed at which the carton 10 is conveyed over the nozzle plate in a continuous or intermittent system as well as the thickness and quick drying of the adhesive 32, among other factors.

Additionally, the caulk lines 36 and 38 of the second outside major flap 26 can mate with the caulk lines 51 and 53 of the first inside major flap 24 within the gaps 4. This provides an adhesive-to-adhesive seal which spans the board thickness of the minor flaps 28 and 30.

Modifications and variations of the present invention are possible in light of the above teachings. It is to be understood that within the scope of the claims the invention may be practiced other than specifically described.

I claim:

1. A carton having a pattern of adhesive provided thereon for forming a reverse folded sift proof carton, comprising:

a carton having a pair of opposite sides, a pair of opposite ends, and at least an open top including a first inside major flap, a second outside major flap, and a pair of opposed minor flaps, wherein each one of said flaps is pivotably connected to a respective one of said opposite sides and said opposite ends of said carton so as to be foldable inwardly with respect to said open top of said carton and thereby close off said open top of said carton;

a first adhesive provided upon opposite sides and opposite ends of an inside surface portion of said second outside major flap of said carton such that said first adhesive extends substantially continuously about the entire periphery of said inside surface portion of said second outside major flap of said carton;

a second adhesive provided upon peripheral areas of an outside surface portion of said first inside major flap of said carton such that said second adhesive is disposed upon opposite ends of said outside surface portion of said first inside major flap of said carton as well as substantially the entire extent of opposite sides of said outside surface portion of said first inside major flap of said carton wherein said extent of said opposite sides of said outside surface portion of said first inside major flap is substantially coextensive with said opposite sides of said inside surface portion of said second outside major flap of said carton; and a third adhesive provided upon peripheral areas of inside surface portions of said pair of minor flaps;

a portion of said second adhesive provided upon said outside surface portion of said first inside major flap and a portion of said third adhesive provided upon said inside surface portions of said pair of minor flaps together defining integral adhesive beads which extend across first and second gaps defined between said first inside major flap and said pair of minor flaps when said first inside major flap is folded inwardly over said open top of said carton and said pair of minor flaps are disposed in open, unfolded positions; and said first adhesive provided upon said opposite sides of said inside surface portion of said second outside major flap and said second adhesive provided upon said opposite sides of said outside surface of said first inside major flap cooperate together so that upon engagement of said inside surfaces of said pair of minor flaps with said outside surface of said first inside major flap, and upon engagement of said inside surface of said second outside major flap with outside surfaces of said pair of minor flaps and with said outside surface of said first inside major flap, when said pair of minor flaps and said second outside major flap are folded inwardly over said folded first inside major flap, a peripheral seal, defined between said second and third adhesives of said outside surface portion of said first inside major flap and said inside surfaces portions of said pair of minor flaps, said first adhesive upon said opposite ends of said inside surface of said second outside major flap and said outside surfaces of said pair of minor flaps, and said first adhesive and second adhesive extending along said opposite sides of said outside surface portion of said first inside major flap and said inside surface portion of said second outside major flaps, extends about the entire periphery of said top of said carton such that said carton is rendered sift proof.

2. The carton as set forth in claim 1, wherein:

said integral adhesive beads which extend across said first and second gaps defined between said first inside major flap and said pair of minor flaps are disposed only within the vicinity of corner regions of said carton so as to prevent sifting of material from said carton between said first inside major flap and said pair of minor flaps.

3. The carton as set forth in claim 1, wherein:

said carton comprises opposite, open top and bottom ends;

each one of said open top and bottom ends comprises a first inside major flap, a second outside major flap, and a pair of minor flaps; and said first inside major flap, said second outside major flap, and said pair of minor flaps comprising said open bottom end of said carton has first, second, and third adhesives disposed thereon which are identical to said first, second, and third adhesives disposed upon said first inside major flap, said second outside major flap, and said pair of minor flaps comprising said open top end of said carton.

4. The carton as set forth in claim 1, wherein:

said first adhesive provided upon said inside surface of said second outside major flap comprises a pair of beads of adhesive extending along longitudinally extending sides of said second outside major flap and disposed parallel to said sides of said carton, and two sets of adhesive beads extending respectively along opposite ends of said second outside major flap.

5. The carton as set forth in claim 4, wherein:

each one of said two sets of adhesive beads comprises a plurality of adhesive beads disposed parallel to each other and extending in a direction parallel to said longitudinally extending sides of said second outside major flap.

6. The carton as set forth in claim 1, wherein:

said second adhesive provided upon said outside surface of said first inside major flap comprises a pair of beads of adhesive extending along longitudinally extending sides of said first inside major flap and disposed parallel to said sides of said carton.

7. The carton as set forth in claim 4, wherein:

said second adhesive provided upon said outside surface of said first inside major flap comprises a pair of beads of adhesive extending along longitudinally extending sides of said first inside major flap and disposed parallel to said sides of said carton so as to adhesively bond with said pair of beads of adhesive disposed upon said inside surface of said second outside major flap when said second outside major flap is folded inwardly over said folded first inside major flap.

8. The carton as set forth in claim 7, wherein:

each one of said pair of minor flaps has a longitudinal length which is less than one-half the longitudinal length of said first inside major flap and said second outside major flap so as to define a space between said pair of minor flaps when said pair of minor flaps are folded inwardly onto said first inside major flap so as to permit portions of said second outside major flap to be bonded directly to portions of said first inside major flap when said second outside major flap is folded inwardly over said first inside major flap.

9. The carton as set forth in claim 1, wherein:

each one of said pair of minor flaps comprises a cut-out portion defined within a corner region thereof which is disposed adjacent to a longitudinal side of said first inside major flap which is pivotably connected to a longitudinal side of said carton so as to expose a portion of said first inside major flap, when said pair of minor flaps are folded inwardly over said folded first inside major flap, for direct bonded engagement with a portion of said second outside major flap when said second outside major flap is folded over said first inside major flap.

10. The carton as set forth in claim 1, wherein:

said carton is fabricated from paperboard.

11. The carton as set forth in claim 1, wherein:

said first inside major flap, said second outside major flap, and said pair of opposed minor flaps are pivotably connected to said respective one of said opposite sides and said opposite ends of said carton by scored fold lines.

12. The carton as set forth in claim 1, wherein:

said carton comprises a rectangular solid when said first inside major flap is folded inwardly so as to close said open top of said carton, when said pair of minor flaps are folded inwardly over said folded first inside major flap, and when said second outside major flap is folded inwardly over said folded first inside major flap and said folded pair of minor flaps.

13. The carton as set forth in claim 1, wherein:

said first inside major flap and said second outside major flap each has a substantially rectangular configuration.

* * * * *